US006739488B1

(12) United States Patent
Sharpe

(10) Patent No.: US 6,739,488 B1
(45) Date of Patent: May 25, 2004

(54) TABLET CUTTER

(75) Inventor: Gary L. Sharpe, Circleville, OH (US)

(73) Assignee: Health Care Logistics, Inc., Circleville, OH (US)

( * ) Notice: Subject to any disclaimer, the term of this patent is extended or adjusted under 35 U.S.C. 154(b) by 0 days.

(21) Appl. No.: 09/649,282

(22) Filed: Aug. 28, 2000

(51) Int. Cl.[7] ..... B26F 3/00
(52) U.S. Cl. ..... 225/93; 225/96; 225/104
(58) Field of Search ..... 225/96, 96.5, 93, 225/97, 103, 104, 105

(56) References Cited

U.S. PATENT DOCUMENTS 2,655,259 A * 10/1953 Davoren ..... 225/103 X
3,640,437 A * 2/1972 Galy ..... 225/96.5
4,422,553 A * 12/1983 Hoeks et al. ..... 225/96.5 X
4,697,344 A * 10/1987 Leopoldi ..... 225/103 X
4,824,000 A * 4/1989 Baxter et al. ..... 225/103
4,887,755 A * 12/1989 Gibilisco ..... 225/103
4,903,877 A * 2/1990 Hnatuk ..... 225/93
5,038,475 A * 8/1991 Wolff ..... 225/103 X
5,118,021 A * 6/1992 Fiocchi ..... 225/103
5,944,243 A * 8/1999 Weinstein ..... 225/93

* cited by examiner

*Primary Examiner*—Charles Goodman
(74) *Attorney, Agent, or Firm*—Standley Law Group LLP

(57) ABSTRACT

The present invention is a tablet cutter. The tablet cutter has a blade support portion, a cutting blade and a tablet support portion. The blade support portion has a hollow rectangular box shape portion with five sides and one open end. The cutting blade is affixed to the interior of the blade support portion. The tablet support portion has at least one tablet holder. The blade support portion may be adapted to enclose the tablet support portion as the tablet support portion slidingly engages the blade support portion.

8 Claims, 4 Drawing Sheets

TABLET CUTTER

BACKGROUND

Oftentimes persons need to divide tablets or pills in order to reduce the dosage or facilitate the administering of prescription or over the counter medications. Manually breaking the tablets has proven to be quite difficult due to the small size and rigidity of most tablets. Accordingly, means of breaking or cutting the tablets have been developed. Traditional devices for accomplishing this task are often unsafe, expensive, bulky or otherwise inconvenient.

One of the problems associated with existing devices for dividing tablets is that the blades are exposed. Since these cutting blades have to be very sharp in order to make a clean cut, it is extremely dangerous to have them exposed. A mere slip of the hand while attempting to use a device with exposed blades could result in severe injury. Moreover, children and the elderly are more likely to be injured while attempting to use, or misuse, such a device.

Another problem associated with traditional cutting devices is that they do not accommodate the myriad of tablet shapes that can be encountered. Odd sized or shaped tablets oftentimes do not fit securely in recesses or frames found in the traditional devices.

Existing devices also have the disadvantage of being large, bulky, or otherwise inconvenient to carry around.

Accordingly, it is desirable to provide a tablet cutter that offers the safety of a hidden blade, the versatility of multiple tablet holders, and the convenience of a compact design.

A device that has a hidden blade will lessen the possibility of injury due to accidents or misuse. Having the capability to adapt to and efficiently cut a much larger selection of tablet sizes or shapes will eliminate the need to own multiple cutters to cut different sized tablets. It is also desirable to have a tablet cutter that is compact enough to fit in a purse or pocket so that tablets can be cut anywhere as opposed to only at home.

Other advantages or the solution to problems may become apparent to one of ordinary skill in the art thorough use of the invention.

SUMMARY OF THE INVENTION

In general terms, the invention includes a tablet cutter comprising: (a) a blade support portion, the blade support portion comprising an insert end and a cutting blade affixed to the blade support portion, the cutting blade oriented toward the insert end; (b) a tablet support portion, the tablet support portion being adapted to slidingly engage the blade support portion from the insert end, the tablet support portion having at least one slotted tablet holder adapted to hold a tablet in place as the tablet support portion slidingly engages the blade support portion such that the cutting blade passes through the at least one slotted tablet holder as the tablet support portion slidingly engages the blade support portion.

The tablet cutter of the present invention preferably has at least one slotted tablet holder shaped so as to hold tablets selected from the group consisting of square tablets, triangular tablets, ovoid tablets, elliptical tablets, and round tablets. Most preferably, the tablet cutter has at least one slotted tablet holder comprising at least two slotted tablet holders shaped so as to hold tablets, at least two of which are selected from the group consisting of square tablets, triangular tablets, ovoid tablets, elliptical tablets, and round tablets.

There may be one or more tablet holders mounted to the tablet support portion that are used for holding in place tablets of various sizes and shapes. Each tablet holder can be shaped according to the type of tablet for which it is to hold. The holders can be of many different sizes and shapes.

In an alternative embodiment, the tablet support portion of the tablet cutter comprises at least two slotted tablet holders adapted to hold tablets according to at least one dimension of a tablet. The sizes of the tablet holders can be varied thereby accommodating different sizes of tablets.

In a preferred embodiment, the invention includes a tablet cutter comprising: (a) a blade support portion, the blade support portion comprising a hollow rectangular box having one open insert end and a cutting blade affixed to the inside of the blade support portion, the cutting blade oriented toward the insert end; (b) a tablet support portion, the tablet support portion being adapted to slidingly engage and fit inside the blade support portion from the insert end, the tablet support portion having at least one slotted tablet holder adapted to hold a tablet in place as the tablet support portion slidingly engages the blade support portion such that the cutting blade passes through the at least one slotted tablet holder as the tablet support portion slidingly engages the blade support portion.

Preferably, the tablet cutter has a handle to allow the tablet support portion to be easily removed from the blade support portion and for preventing the tablet support portion from being totally enclosed by the blade support portion when the tablet support portion slidingly engages the blade support portion. One way of providing such a handle is to adapt the tablet support portion to have two appendages affixed to the corners of the distal end of the tablet support portion opposite the end at which the tablet support portion slidingly engages the open end of the blade support portion.

The tablet cutter can be made of any type of commercially available material or combination of materials having a rigid nature appropriate to its function, such as wood, plastics or metals.

The shape of the cutting blade that is mounted to the blade support portion can be altered in size, height, and angle of the cutting edge in order to maximize the performance of the tablet cutter.

DETAILED DESCRIPTION OF THE PREFERRED EMBODIMENT(S)

In view of the foregoing summary, the following describes the preferred embodiments of the invention which are also considered to be the best mode.

Figure 1:
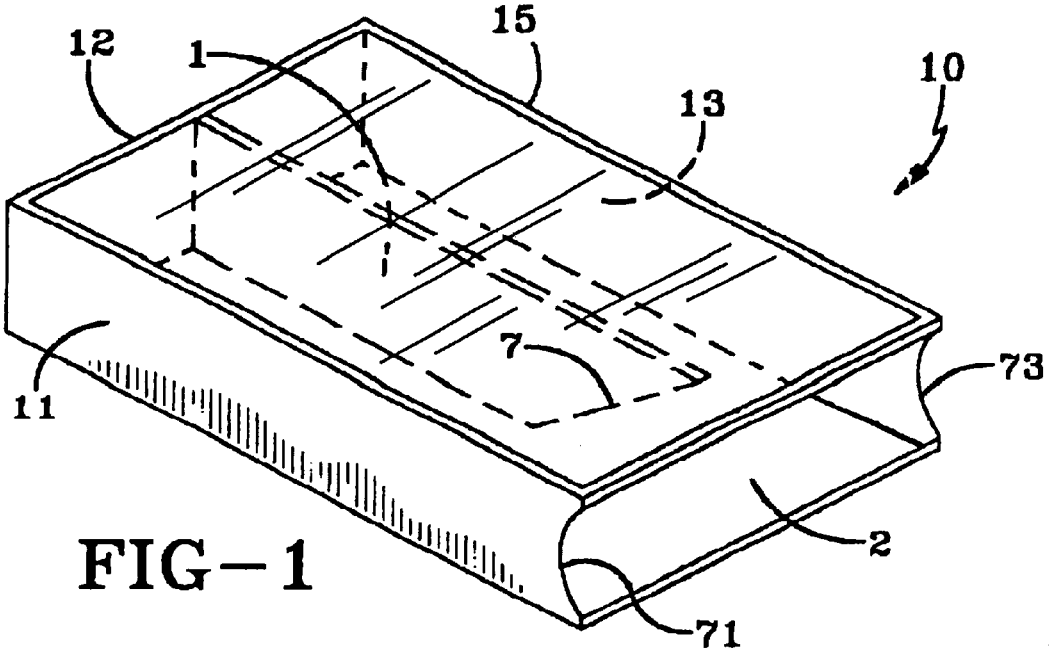
FIG. 1 illustrates a perspective view of the blade support portion of the tablet cutter of the present invention.
Figure 2:
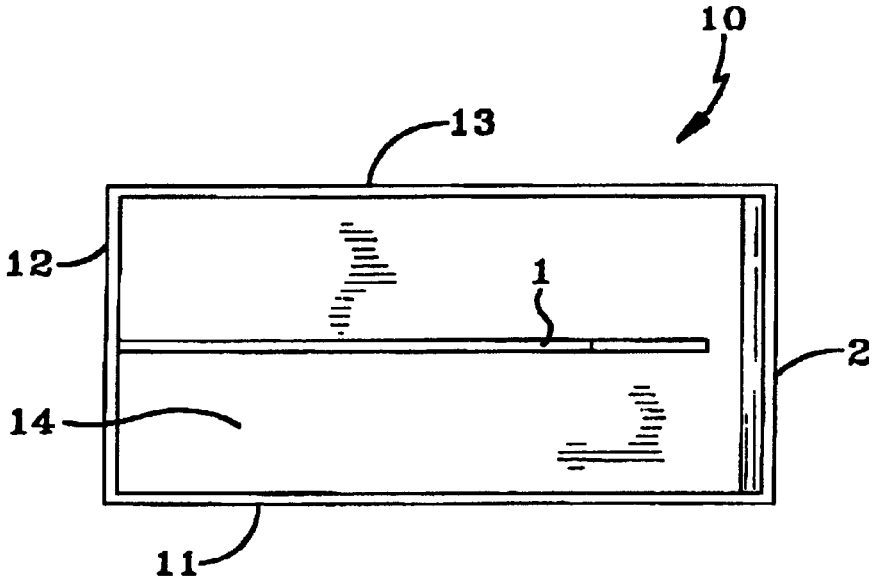
FIG. 2 illustrates a top view of the blade support portion of the tablet cutter of the present invention.

FIGS. 1 and 2 depict a general view of the blade support portion 10. As depicted, the blade support portion comprises a rectangular box with three sides 11, 12,13, a top 15, a bottom 14 and one opening 2. The longitudinal sides 11, 13 each have half moon shaped edges 71, 73 facing the open end 2 of the blade support portion. A blade 1 is affixed to the inside surface of the top 15 of the blade support portion with the blade edge 7 facing the open end 2 of the blade support portion. The blade 1 may be affixed to the blade support portion 10 by various means such as: adhesives, fitted groove or rivets.

Figure 3:
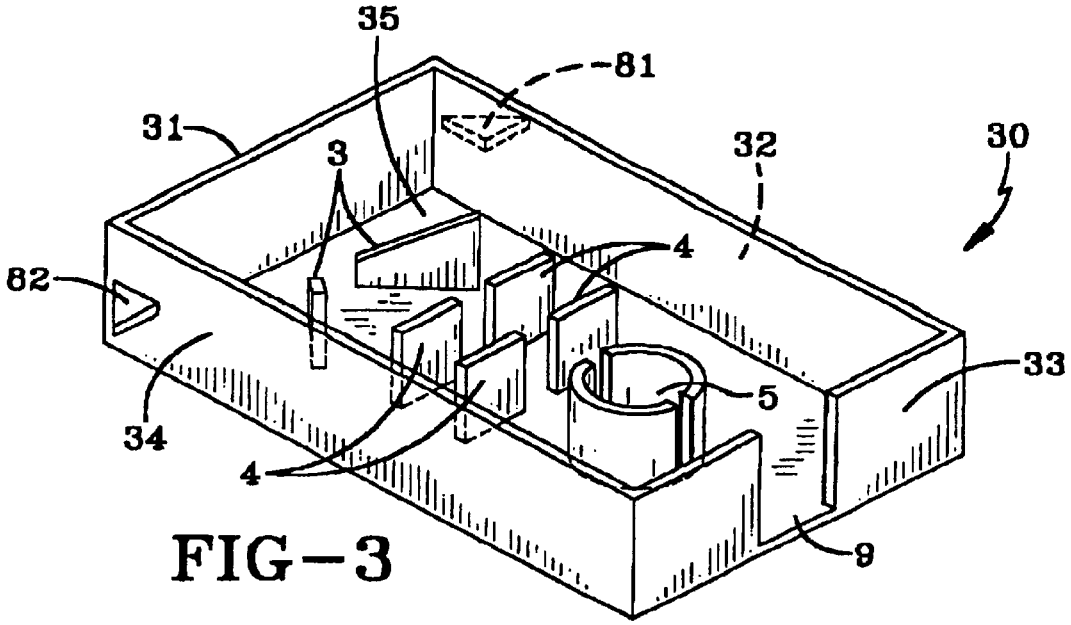
FIG. 3 illustrates a perspective view of the tablet support portion of the tablet cutter of the present invention.
Figure 4:
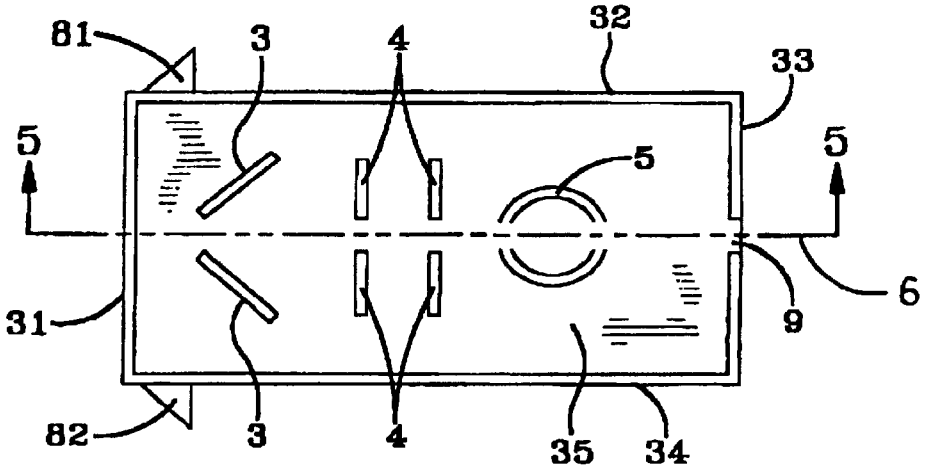
FIG. 4 illustrates a top view of the tablet support portion of FIG. 3.
Figure 5:
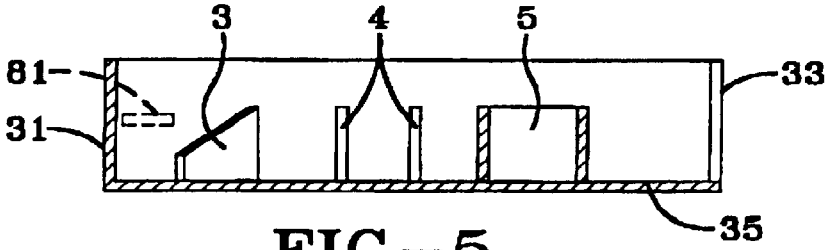
FIG. 5 illustrates a side cross-sectional view of the tablet support portion of FIG. 3 along the line 5—5.

FIGS. 3, 4 and 5 depict a general view of the tablet support portion 30. As depicted, the tablet support portion comprises a bottom 35, a front side 33, a slit 9 in the middle of the front side aligned with the center line 6 of the tablet support portion, longitudinal sides 32, 34, and a distal end 31. Two appendages 81, 82 are affixed, one per side, to the corners of the distal end 31 of the tablet support portion. Tablet holders 3, 4, 5 are affixed to the bottom 35 of the tablet support portion. Each tablet holder is separated through the center of the respective tablet holder along the center line 6 of the tablet support portion and aligned with the slit 9.

In the preferred embodiment depicted, the tablet support portion 30 slidingly engages the blade support portion 10 by entering the opening 2 of the blade support portion and traveling longitudinally along the length of the blade support portion. The blade 1 passes first through the slit 9 of the front side 33 of the tablet support portion and then through the middle of each of the slotted tablet holders 3, 4, 5 as the tablet support portion slidingly engages the blade support portion. The appendages 81, 82 on the tablet support portion abut the edges 71, 73 of the longitudinal sides 11, 13 of the blade support portion as the front side 33 of the tablet support portion nears the rear side 12 of the blade support portion thus preventing the tablet support portion from sliding completely inside of the blade support portion.

In the preferred embodiment depicted, the appendages 81, 82 protruding from the corners of the distal end 31 of the tablet support portion 30 are sawtooth shaped. Other shapes, such as cylindrical, hemispherical, and rectangular can also be used to achieve the same result. It is appreciated that other means of stopping the tablet support portion before it completely enters the blade support portion may be used without materially affecting the present invention. For instance, stopping the tablet support portion with shims affixed to the rear side 12 of the blade support portion would achieve the same result.

The purpose of preventing the tablet support portion from completely entering the blade support portion is to facilitate the removal of the tablet support portion. Accordingly, the appendages could be abandoned completely and replaced by a handle affixed to the distal end 31 of the tablet support portion. The handle could then be used to retrieve the tablet support portion from inside of the blade support portion even if it were completely inside of it.

It is appreciated that various means of adapting the tablet support portion 30 to slidingly engage the blade support portion 10 may be used without materially affecting the present invention. For example, a tongue-and-groove type of arrangement could be employed. Additionally, the blade support portion 10 could be adapted to only partially enclose the tablet support portion 30 instead of entirely enclosing it. Adapting the shape in this manner would differ from the embodiment depicted in FIG. 1, where the blade support portion 10 is adapted to be shaped like a hollow rectangular box.

The tablet cutter can be made of any type of commercially available material or combination of materials having a rigid nature appropriate to its function, such as wood, plastics or metals. Additionally, different means of fabrication, such as injection molding, extrusion molding or machining, may be used without materially affecting the present invention.

In the preferred embodiment depicted, the front edge 7 of the blade 1 is at a 45 degree angle. It is appreciated that the angle, as well as the composition, of the blade may be varied in order to achieve similar results without materially affecting the present invention. The blade 1, affixed to the top 15 of the blade support portion 10, extends downward towards the bottom 14. The depth of the blade is less than the depth of the blade support portion to allow the bottom 35 of the tablet support portion 30 to pass underneath of the blade as the tablet support portion slidingly engages the blade support portion.

In the preferred embodiment depicted, there are three tablet holders 3, 4, 5 affixed to the bottom 35 of the tablet support portion.

The first tablet holder 3 is wedge (or "V") shaped in order to accommodate tablets with wedge shaped sides, including, but not limited to, triangular, hexagonal, or octagonal shapes. Other shapes of tablet holders, such as hyperbolic or trapezoidal, may also be used to achieve similar results.

The second tablet holder 4 comprises two vertical sides for holding tablets with oblong shapes. The vertical sides run laterally across the center line 6 and are both slotted for allowing the blade 1 to pass through as the tablet support portion slidingly engages the blade support portion. The bottom surface 35 between the vertical sides of the tablet holder 4 is adapted to be grooved so as to allow the tablet to be seated as it is severed.

The third tablet holder 5 has a round shape for holding round tablets. The diameter of the tablet holder may be varied without affecting its purpose.

It is appreciated that the shapes, sizes, and number of tablet holders may be varied without materially affecting the present invention. Each tablet holder, regardless of its shape or size, is notched completely through the middle along the center line 6 of the tablet support portion in order to allow the blade 1 to pass through as the tablet support portion slidingly engages the blade support portion.

Figure 3A:
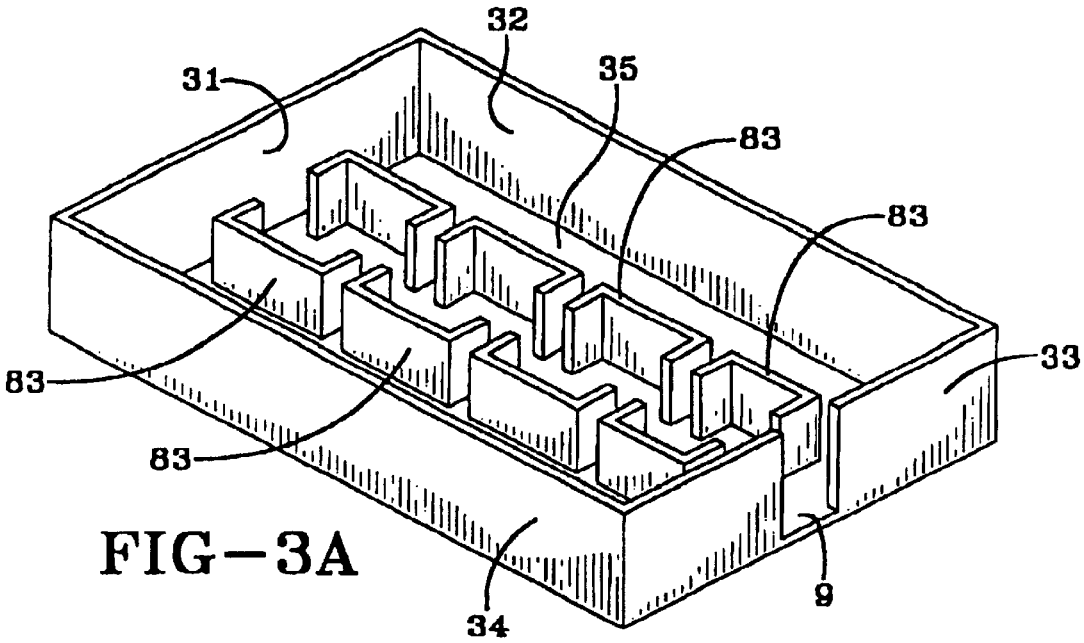
FIG. 3*a* illustrates a perspective view of an alternative embodiment of the tablet support portion of the tablet cutter of the present invention.
Figure 3B:
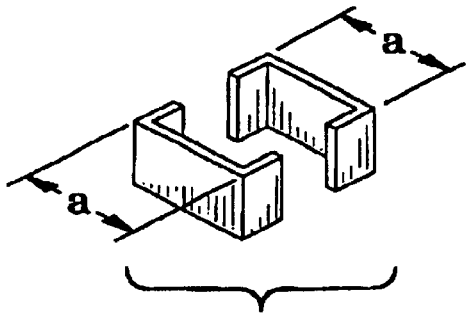
FIG. 3*b* illustrates a perspective view of a tablet holder from the alternative embodiment of the tablet support portion of FIG. 3*a*.
Figure 3C:
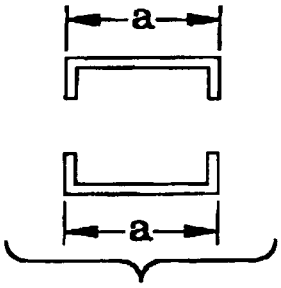
FIG. 3*c* illustrates a plan view of the tablet holder of FIG. 3*b*.

FIGS. 3*a*, 3*b* & 3*c* depict an alternative embodiment of the tablet support portion of the tablet cutter. The blade support portion 10, not shown in FIGS. 3*a*, 3*b* & 3*c*, is unchanged from the preferred embodiment in design and function as it interfaces with the tablet support portion 30.

FIG. 3*a* depicts a perspective view of an alternative embodiment of the tablet support portion. Four slotted tablet holders 83 are affixed to the bottom 35. The slotted tablet holders are similarly shaped and differ from each other in only one dimension.

FIG. 3*b* depicts a perspective view of one of the tablet holders 83. FIG. 3*c* depicts a plan view of one of the tablet holders 83. As can be seen im FIGS. 3*a*, 3*b* & 3*c*, each tablet holder has a rectilinear shape whith the longitudidinal dimension being labeled (a). The rectilinear shape of each of the tablet holders allows tablets to be fitted into them according to only two dimensions. By varying dimension (a), the tablet holder may be adapted to accommodate tablets of different sizes. The number of rectilinear tablet holders can then be chosen to accommodate any number of tablet sizes. The user simply chooses a tablet holder that best fits the tablet.

Figure 4A:
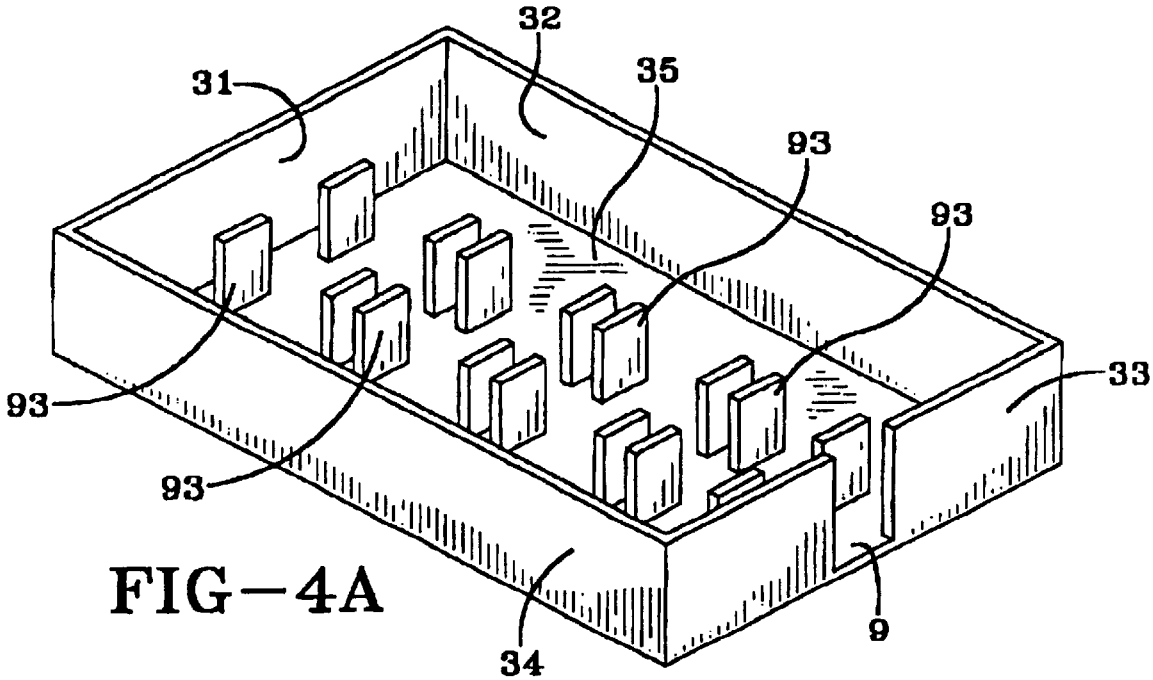
FIG. 4*a* illustrates a perspective view of an alternative embodiment of the tablet support portion of the tablet cutter of the present invention.
Figure 4B:
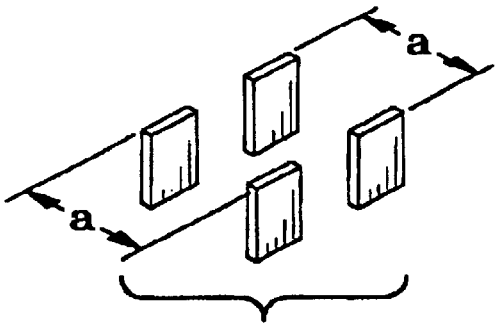
FIG. 4*b* illustrates a perspective view of a tablet holder from the alternative embodiment of the tablet support portion of FIG. 4*a*.
Figure 4C:
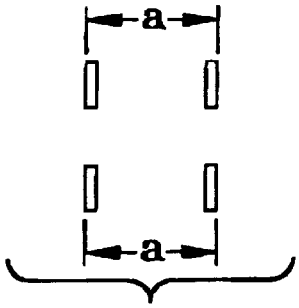
FIG. 4*c* illustrates a plan view of the tablet holder of FIG. 4*b*.

FIGS. 4*a*, 4*b* & 4*c* depict another alternative embodiment of the tablet support portion 30. In this embodiment, the shape of each tablet holder 93 is changed so as to adapt it to be able to hold tablets according to only one dimension. In the embodiment depicted in FIGS. 4*a*, 4*b* & 4*c*, the tablet holders 93 differ in only one respect to the tablet holders depicted in FIGS. 3*a*, 3*b* & 3*c*; the outer wall of each tablet holder 93 is omitted. This modified tablet holder 93 design allows an interference fit to be established according to only one dimension of the tablet. The user simply chooses the tablet holder that affords the best fit. This tablet holder design is advantageous because each tablet holder 93 can accommodate a wider array of tablet shapes.

It is appreciated that the number of tablet holders may be varied somewhat to accommodate the desired number of tablets. It is likely that by adapting the tablet support portion to contain from four to twelve tablet holders the tablet cutter can be adapted to accommodate a sufficient number of tablets.

Features in addition to those pointed out will readily occur to those versed in the art, as will many modifications in the preferred embodiments disclosed, all without departure from the spirit and scope of the invention.

What is claimed is:

1. A tablet cutter; said tablet cutter comprising:

(a) a blade support portion, said blade support portion comprising an insert end opening and a cutting blade affixed to said blade support portion, said cutting blade oriented toward said insert end opening and recessed from said insert end opening;

(b) a tablet support portion, said tablet support portion having at least one slotted tablet holder structure to hold a tablet in place within said tablet support portion, such that said tablet support portion may slidingly engage and fit inside said blade support portion from said insert end, such that said cutting blade passes through said at least one slotted tablet holder structure as said tablet support portion slidingly engages said blade support portion.

2. The tablet cutter according to claim 1 wherein said at least one slotted tablet holder is shaped so as to hold tablets selected from the group consisting of square tablets, triangular tablets, ovoid tablets, elliptical tablets, and round tablets.

3. The tablet cutter according to claim 1 wherein said at least one slotted tablet holder comprises at least two slotted tablet holders shaped so as to hold tablets at least two of which are selected from the group consisting of square tablets, triangular tablets, ovoid tablets, elliptical tablets, and round tablets.

4. The tablet cutter according to claim 1 wherein said at least one slotted tablet holder comprises at least two slotted tablet holders each defining a different dimension of said tablets.

5. A tablet cutter, said tablet cutter comprising:

(a) a blade support portion, said blade support portion comprising a hollow rectangular box having one open insert end and a cutting blade affixed to said blade support portion, said cutting blade oriented toward said insert end;

(b) a tablet support portion, said tablet support portion having a front end with a slit and a distal end, said tablet support portion slidingly engages and fits inside said blade support portion from said insert end, said tablet support portion having at least one slotted tablet holder structure disposed such that said cutting blade passes through said at least one slotted tablet holder structure as said tablet support portion slidingly engages said blade support portion.

6. The tablet cutter according to claim 5 wherein said at least one slotted tablet holder is shaped so as to hold tablets selected from the group consisting of square tablets, triangular tablets, ovoid tablets, elliptical tablets, and round tablets.

7. The tablet cutter according to claim 5 wherein said at least one slotted tablet holder comprises at least two slotted tablet holders shaped so as to hold tablets at least two of which are selected from the group consisting of square tablets, triangular tablets, ovoid tablets, elliptical tablets, and round tablets.

8. The tablet cutter according to claim 5 wherein said distal end of said tablet support portion comprises at least one appendage for preventing said tablet support portion from being totally enclosed by said blade support portion so that said tablet support portion may be easily removed from said blade support portion as said tablet support portion slidingly engages said blade support portion.

* * * * *